United States Patent [19]

Bennett

[11] 4,416,655

[45] Nov. 22, 1983

[54] CENTRIFUGES AND CENTRIFUGE CLEANING METHODS

[75] Inventor: Peter H. E. Bennett, East Grinstead, England

[73] Assignee: The Chartwell House Group Limited, England

[21] Appl. No.: 286,907

[22] Filed: Jul. 27, 1981

[30] Foreign Application Priority Data

Mar. 19, 1981 [EP] European Pat. Off. ..... 81301180.6
Jan. 19, 1981 [GB] United Kingdom ..... 8101565

[51] Int. Cl.[3] ..... B04B 11/08

[52] U.S. Cl. ..... 494/40; 494/52; 494/56

[58] Field of Search ..... 494/40, 41, 52, 55, 494/64, 53, 54, 60, 62, 63, 65, 22, 27, 29, 56, 58

[56] References Cited

U.S. PATENT DOCUMENTS

| | | | |
|---|---|---|---|
| 1,002,525 | 9/1911 | King | 494/52 |
| 3,858,794 | 1/1975 | Nilson | 494/53 |
| 4,141,488 | 2/1979 | Gense | 494/53 |

*Primary Examiner*—Robert W. Jenkins
*Attorney, Agent, or Firm*—McGlew and Tuttle

[57] ABSTRACT

The drum of a centrifugal filter is cleaned by stopping the rotation of blades which normally rotate with the drum, while allowing the drum to continue to rotate, and retracting the bottom of the drum to open an annular aperture through which accumulated contaminants dislodged by the blades discharge.

6 Claims, 5 Drawing Figures

24
23
22
6
9
15
15a
13
12
7
5
14
20
18
19
21
21a
10
11

CENTRIFUGES AND CENTRIFUGE CLEANING METHODS

BACKGROUND OF THE INVENTION

Centrifuges are known for filtering oil used as coolant during milling and other machining operations. The coolant, contaminated by metal particles or shavings, is fed continuously into a rotating centrifuge drum. The contaminants accumulate against the peripheral side wall of the drum while the decontaminated liquid is collected as it discharges through the mouth of the drum. The accumulated contaminants must be removed at periodic intervals. However, known drums cannot be cleaned quickly or easily.

A primary object of the invention is to provide a centrifuge in which the drum can be cleaned quickly and without halting its rotation.

A further object of the invention is to provide a method of cleaning a centrifuge drum automatically without halting the drum or the flow of liquid therethrough.

SUMMARY OF THE INVENTION

Briefly, and in accordance with the invention, the interior of the drum is provided with at least one cleaning member which in normal centrifuging operation rotates together with a peripheral wall of the drum. The cleaning operation is effected by causing the cleaning member to stop rotating (or by otherwise establishing a speed differential between the peripheral wall of the drum and cleaning member ) and by uncovering an opening in the lower part of the drum, whereupon the contaminants are dislodged from the wall of the drum and discharged.

DESCRIPTION OF PREFERRED EMBODIMENTS

Figure 1:
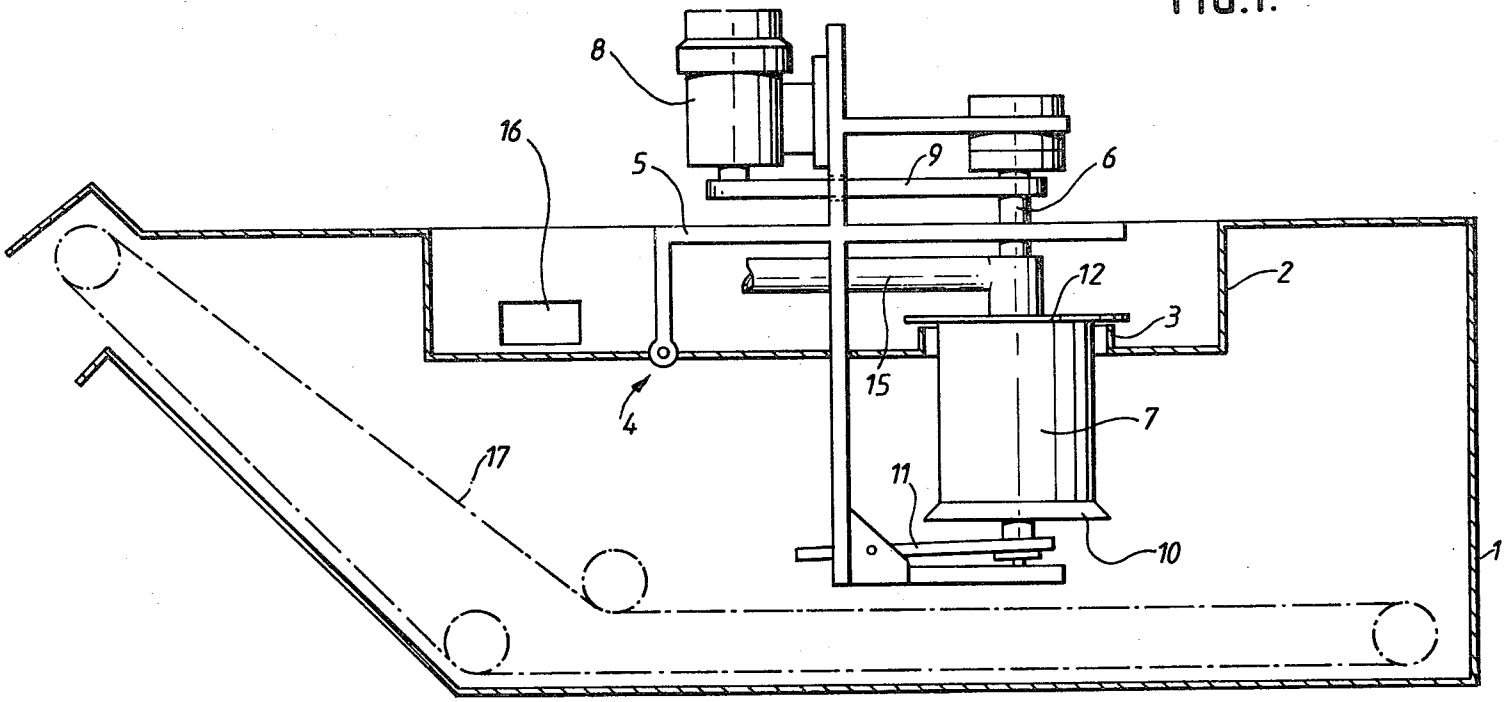
FIG. 1 is a diagrammatic side view of a first embodiment of centrifugal filtering apparatus.
Figure 2:
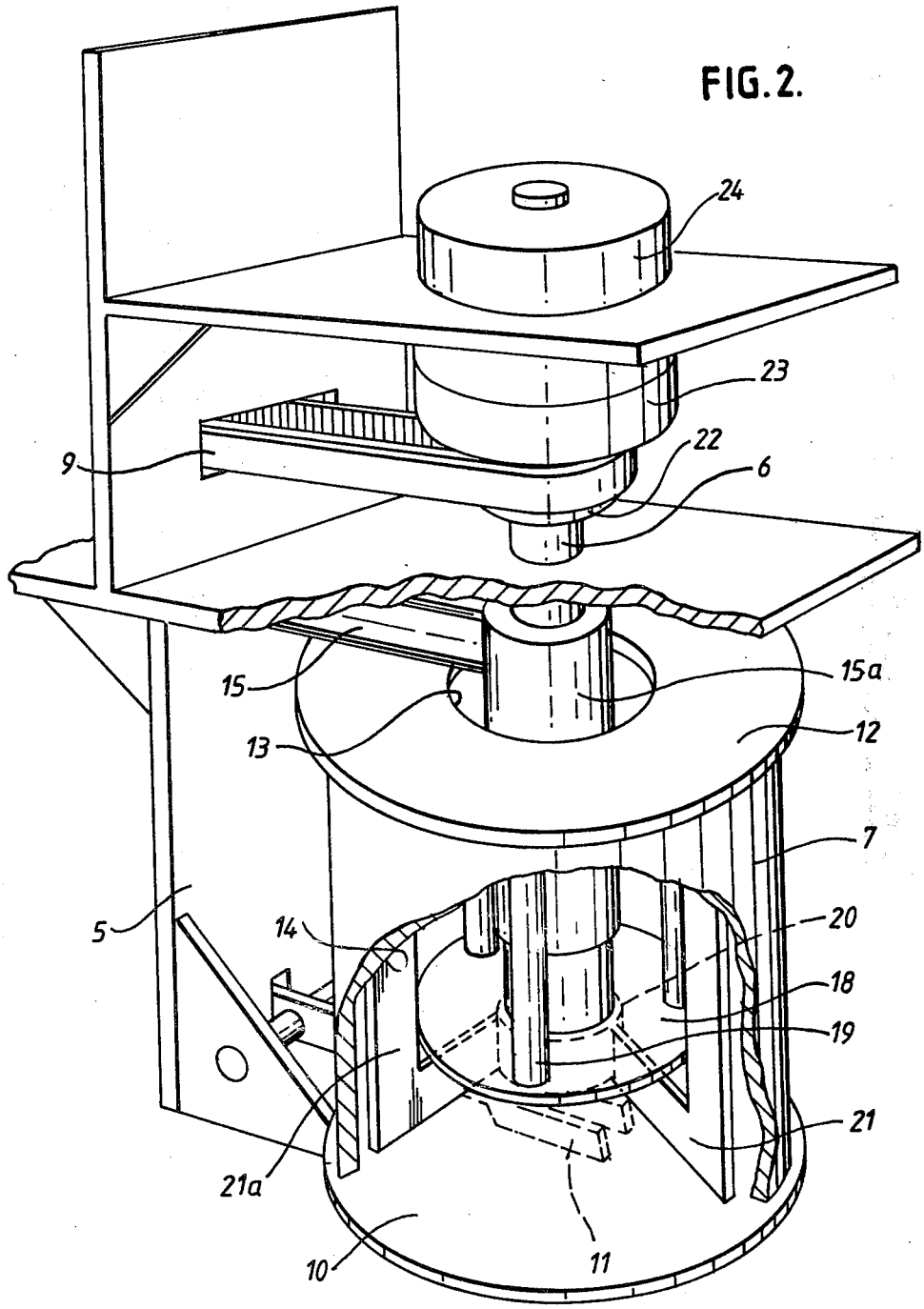
FIG. 2 is a perspective view, partly broken away, of the drum and associated parts of the apparatus shown in FIG. 1.

Referring to FIGS. 1 and 2 of the drawings, the apparatus shown therein comprises a tank 1 for contaminated liquid, and in the upper part of which is arranged a reservoir 2 for filtered coolant. In the base of the reservoir is a circular opening bounded by an upstanding wall 3. Pivoted to the tank at 4 is a support frame 5 provided with bearings for a shaft assembly 6 carrying the centrifuge drum 7. Also mounted on the frame is an electric drive motor 8 for rotating the shaft assembly 6 by way of a belt transmission 9. The drum has a peripheral side wall 14, the lower edge of which defines a discharge aperture closed by a movable bottom wall 10 supported by a link 11 pivoted on the frame. The upper side of the drum is formed by a plate rigid with the peripheral wall and having a central orifice 13 larger in diameter than a supply pipe 15 through which contaminated coolant is supplied from a tank (not shown) which receives the coolant from a machine tool or other working station. The plate 12 is larger in diameter than the peripheral wall 14 and projects radially outwards beyond the wall 3 so that during normal operation of the apparatus, filterd coolant discharges from the drum through the orifice and enters the reservoir 2. As shown in FIG. 2, the supply pipe 15 has a vertical outlet pipe section 15*a* which passes through the orifice 13 and terminates near the botton of the drum. The shaft assembly 6 extends co-axially through the outlet pipe section 15*a*, a suitable seal being provided at the upper end of the outlet pipe section. Within the reservoir 2 is an outlet 16 to a tank for clean coolant. A pumping system may be provided for returning to the contaminated coolant tank any liquid which overflows into the tank 1 from the reservoir 2 or which enters the tank during cleaning of the drum in the manner shortly to be described. Within the tank is a draglink conveyor 17 for removing sludge deposited in the tank 1 during the cleaning operation.

The shaft assembly 6 consists of a set of co-axial shafts, not illustrated individually, one of which is drivably connected to annular disc 18 connected by vertical bars 19 with the plate 12 which is rigid with the peripheral wall 14. Another of the co-axial shafts has a collar 20 carrying a group of equiangularly spaced vanes or blades 21 having upwardly extending portions 21*a*, the radially outer edges of which are in contact with, or narrowly spaced from, the inner surface of the peripheral wall 14 of the drum and serve as scrapers for dislodging accumulated contaminants. A further shaft may be provided to drive the retractable bottom wall 10 or, instead, the bottom wall may be driven from the peripheral wall 14 by suitable guides on which the bottom wall is slidable vertically. Alternatively, the bottom wall 10 may be undriven. The shaft driving the peripheral wall 14 and plate 12 is driven directly by the pulley 22 of the belt drive 9, whereas the shaft driving the vanes 21 is driven from the pulley 22 by way of an electro-magnetic clutch 23. This latter shaft may be brought to a halt, or at least its speed reduced, by a brake 24.

The components of the apparatus mounted on the frame 5 may be made accessible for servicing by tilting the frame about the pivot 4 after detaching part of the reservoir.

In operation, contaminated coolant is supplied continuously through the pipe 15 to the lower part of the interior of the drum which rotates at about 3,000 r.p.m. Centrifugal force throws the contents of the drum towards the peripheral wall 14 where the solid particles are trapped while the filtered liquid escapes through the orifice 13 to flow across the top plate 12 into the reservoir 2. Because the outlet pipe section 15*a* discharges near the bottom of the drum, less dense particles, for example particles of aluminium, are less likely to be carried away with the filtered liquid than in known centrifugal filter apparatus. The centrifuging action of the drum is aided by the vanes 21 which, during normal operation, rotate at the same speed as the peripheral wall 14 and ensure that the liquid moves at a constant speed. When accumulated contaminants are to be removed from the interior of the drum, either at pre-set intervals or in response to the operation of a sensor indicating an appropriate accumulation of contaminants, the electro-magnetic clutch 23 is de-activated so that the shaft driving the vanes 21 ceases to be driven while the peripheral wall 14 and plate 12 continue to rotate. The brake 24 is operated to halt the vanes 21 which dislodge or scrape the contaminants from the peripheral wall. Simultaneously, the bottom wall 10 is retracted by the link 11 acted upon by a mechanism (not shown) to form an annular slot between the bottom edge of the peripheral wall 14 and the bottom wall 10, the accumulated contaminants being driven out through the annular slot by the action of the stationary vanes co-operating with the spinning peripheral wall 14 of the drum. Removal of the contaminants is assisted by the flushing action of liquid which continues to be supplied to the drum. The bottom wall 10 may cease to rotate, or continue to rotate, depending upon the manner in which it is arranged.

Scavenging of the drum is completed in a matter of seconds and the bottom wall 10 is returned to its normal upper position and rotation of the vanes 21 re-started. Because the cleaning operation takes place so quickly there is no risk of the supply of coolant being interrupted and it is easily possible to meet the requirements of the machining operation by maintaining a sufficient quantity of coolant in the clean coolant tank.

The tank 1 may be dimensioned to accommodate a number of centrifuge drums, the number of drums in use depending on, for example, the viscosity of oil to be filtered. Cleaning of the various centrifuge drums may take place in sequence or simultaneously. Alternatively, each of a number of drums may be associated with a respective machine tool.

Figure 3:
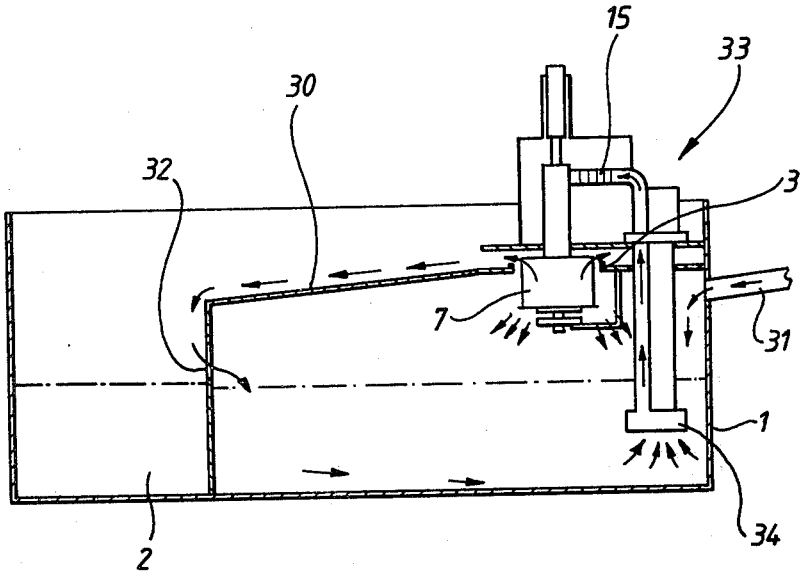
FIG. 3 is a view similar to FIG. 1 but of a second embodiment of centrifugal filtering apparatus.
Figure 4:
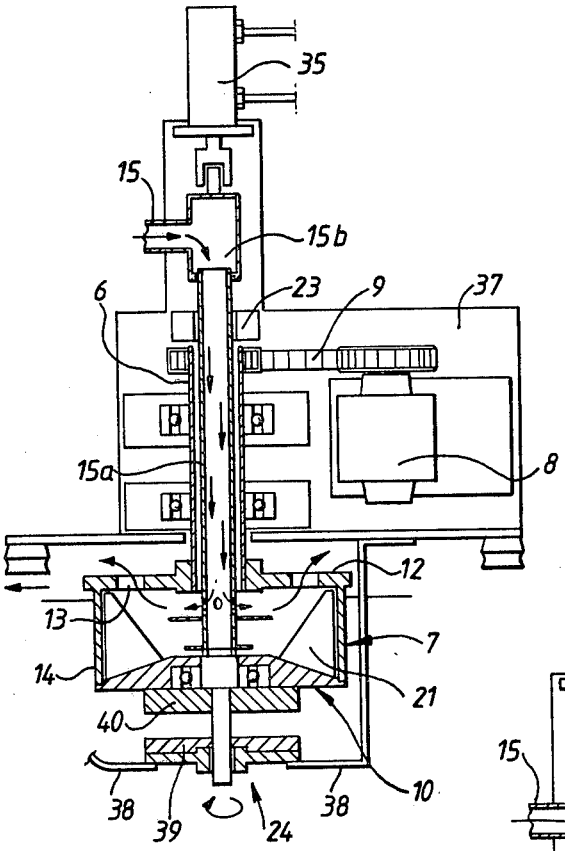
FIG. 4 is a section taken on the axis of rotation, and showing the drum and associated parts of the apparatus shown in FIG. 3, the apparatus being depicted in its filtering mode.
Figure 5:
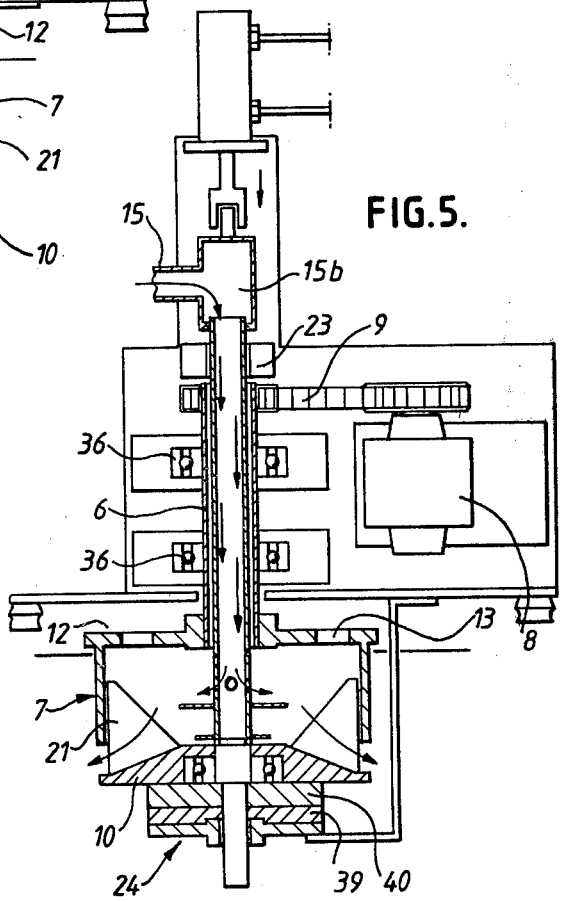
FIG. 5 is a view similar to FIG. 4 but showing the apparatus in its cleaning mode.

The second construction of apparatus will now be described with reference to FIGS. 3 to 5, wherein the same reference numerals are used as in FIGS. 1 and 2 to denote the same components. In this apparatus, the tank 1 for contaminated liquid and the reservoir 2 for filtered liquid are arranged side by side, the tank 1 being surmounted by a cover 30 in which is formed the opening for receiving the drum 7. The cover 30 slopes down towards the reservoir 1 to enable filtered liquid discharged from the drum to flow into the reservoir. Contaminated liquid supplied from a working station is discharged direct into the tank 1 from a pipe 31, and excess quantitites of tiltered liquid entering the reservoir pass into the tank 1 through an overflow 32. A pump 33 having an inlet 34 draws up contaminated liquid from tank 1 and discharges it to a flexible supply pipe 15 of centrifuge drum 7.

The supply pipe 15 of this construction communicates with the interior of a hollow support **15*b* in which is journalled the upper end of an inner hollow drive shaft 15*a* coupled to the bottom wall 10 of the drum 7. A pneumatic piston and cylinder unit 35 is coupled to the support 15*b* in order to move it and shaft 15*a* between the raised position shown in FIG. 4 in which the bottom of the drum 7 is closed and the lowered position shown in FIG. 5** in which the bottom is open.

The hollow shaft **15*a* passes through an outer hollow drive shaft 6, and is driven therefrom by a clutch 23. The outer shaft 6 is supported on bearings 36 and driven continuously in rotation when in use by a motor 8 through belt transmission 9. The outer shaft 6 is fast with the cover plate 12 of the drum 7, the plate 12 having a circumferentially extending ring of orifices 13** for the discharge of filtered liquid.

The bottom wall 10 is of frusto-concial shape and has mounted thereon the vanes 21 which, in this construction, are each of substantially triangular shape.

The motor 8, piston and cylinder unit 35, and bearings 36 are mounted on a main frame structure 37 supported about tank 1. Brackets 38 project downwardly from the structure 37 and support a stationary friction pad 39 of a brake 24. Pad 39 co-operates with a pad 40 on the underside of bottom wall 10 when the bottom wall is lowered into the position shown in FIG. 5, for the purpose of braking the bottom wall 10 and vanes 21.

Operation is similar to that of the first-described construction. During operation, the plate 12 and peripheral wall 14 are driven from the shaft 6 which is connected to the plate 12 directly. When the apparatus is in the filtering mode shown in FIG. 4, the bottom wall 10 and vanes 21 are driven from the inner shaft **15*a* through clutch 23 from the outer shaft. Contaminated liquid is drawn from tank 1 by pump 33 and enters the drum through pipe 15, hollow support support 15*b* and hollow shaft 15*a*. Filtered liquid discharges from orifices 13 to flow down cover 30 into reservoir 2**.

To enter the cleaning mode, a control device responsive to a timer or sensor extends piston and cylinder unit 35 to lower shaft **15*a* and bottom wall 10, pipe 15 flexing slightly to permit this movement. The clutch 23 disengages drive to the inner shaft 15*a* and the friction pads 39, 40 engage and bring the bottom wall 10 and vanes 21 to a halt, thereby scraping accumulated contaminants from the inner surface of wall 14** and scavenging the drum.

In a modification of this construction, the inner shaft is undriven and the bottom wall 10 is driven frictionally from the peripheral wall 14 during the filtering operation.

Modifications may be made to either arrangement illustrated. Thus, for example, there are many alternative ways of driving the drum and vanes differentially when required for cleaning. Similarly, other methods of opening a discharge outlet in the bottom or lower end of the drum may be used. Other means may be provided for removing the sludge from the tank 1. The apparatus may be made from any suitable material, although nylon is thought to be especially suitable for the vanes and bottom wall 10. It is possible for there to be a certain amount of slip between the vanes and the drum during normal filtering operation, it being of the essence that during cleaning there is established a speed differential such as to dislodge the accumulated contaminants. Instead of physically retracting the bottom wall 10, it may be allowed to descend under its own weight, following retraction of a bottom wall support. Other arrangements may, of course, be provided for opening an aperture to permit discharge of contaminants. Thus, the drum may have a fixed bottom wall, and an annular closure member covering part annular slots in the peripheral drum wall, the closure being raised to open the slots. Conceivably, a cleaning member which is movable relative to the drum, other than in a rotational sense, may be used in combination with one or more closable contaminant discharge apertures.

I claim:

1. In a centrifuge comprising a drum, a drive system for rotating the drum, an inlet for supplying contaminated liquid to the drum, the drum having at least one orifice in its upper part to permit the discharge of filtered liquid; the improvement comprising an apertured lower end to the durm, a closure movable between a position in which said aperture is closed by the closure and a position in which the aperture is open, a cleaning member disposed within the drum for movement relative to the axis drum; means for effecting displacement of said closure into its position uncovering the aperture during a cleaning operation, and means for establishing relative movement between the cleaning member and the drum during such cleaning operation, said drum having a peripheral wall drivable continuously in rotation by the drive system, the lower end of said wall defining said aperture, said closure being constituted by a bottom wall movable parallel to the axis of the drum between a raised closed position and a lowered open position.

2. A centrifuge according to claim 1, said peripheral wall and said bottom wall being drivable independently of each other by coaxial shafts drivably connected with each other through a clutch.

3. A centrifuge according to claim 2, said cleaning member comprising a plurality of vanes, means being provided for driving the vanes at substantially the same speed as the drum during filtering and for halting the vanes during the cleaning operation.

4. A centrifuge according to claim 3, said vanes being mounted on said closure.

5. A centrifuge according to claim 4, further comprising a tank for containing contaminated liquid, a wall surmounting the tank and having therein an opening within which said drum is located.

6. In a centrifuge comprising a drum, a drive system for rotating the drum, an inlet for supplying contaminated liquid to the drum, the drum having at least one orifice in its upper part to permit the discharge of filtered liquid, the improvement comprising a wall member having therein a circular aperture within which said drum is disposed, means for collected filtered liquid discharged onto said wall member from the drum via said at least one orifice, a tank disposed beneath said wall member for receiving contaminated liquid; said drum having a peripheral wall and being open bottomed, a closure for said open bottom, means for displacing said closure from a position closing said open bottom into a position defining an annular aperture, during a drum cleaning operation, and a cleaning member within said drum for effecting discharge of accumulated contaminants through said aperture.

* * * * *